United States Patent [19]

Hering

[11] Patent Number: 4,739,641

[45] Date of Patent: Apr. 26, 1988

[54] PROCESS AND APPARATUS FOR FLATTENING SHEET GAUGE METAL SCRAP

[75] Inventor: Alfred G. Hering, Hudson, Ohio

[73] Assignee: Connell Limited Partnership, Boston, Mass.

[21] Appl. No.: 856,575

[22] Filed: Apr. 25, 1986

[51] Int. Cl.[4] ..... B21B 21/00

[52] U.S. Cl. ..... 72/199; 29/DIG. 31; 72/237; 419/23; 419/43

[58] Field of Search ..... 419/23, 38, 43; 72/199, 72/237, 243; 29/DIG. 31

[56] References Cited

U.S. PATENT DOCUMENTS

| | | | |
|---|---|---|---|
| 2,937,942 | 5/1960 | Lonel | 419/43 |
| 3,455,136 | 7/1964 | Polakowski | 72/199 |
| 4,588,552 | 5/1986 | Schroder et al. | 29/DIG. 31 |

*Primary Examiner*—W. Donald Bray

*Attorney, Agent, or Firm*—James A. Drobile; Robert A. Koons, Jr.

[57] ABSTRACT

A novel process is disclosed by which contorted or distorted sheet gauge steel and other metal scrap material, generated by stamping and other deforming metal-working operations, is flattened by rolls for the purpose of increasing its bulk density and to provide a scrap product that can more efficiently be transported and used for remelting in steel-making and foundry furnaces. The process involves the steps of feeding contorted sheet metal scrap between a pair of moving compressive surfaces, compressing the scrap to substantial flatness, and discharging the flattened steel scrap. The novel apparatus for performing the process is also disclosed.

10 Claims, 3 Drawing Sheets

PROCESS AND APPARATUS FOR FLATTENING SHEET GAUGE METAL SCRAP

BACKGROUND OF THE INVENTION

1. Field of the Invention.

The invention relates to sheet gauge metal scrap, and to the treatment and processing of such scrap material to facilitate its remelting and re-use in steel making and foundry furnaces. In particular, the invention relates to a process and apparatus in which sheet gauge steel and other metal scrap, produced by stamping and other metal-working operations, is flattened for the purpose of increasing its bulk density to enable it to be transported and used more efficiently in steel-making and foundry furnaces.

2. Description of the Prior Art.

When sheet metal parts are formed in a stamping press, the scrap metal residue is typically bent, deformed, contorted, or distorted in some fashion, so that a piece of flat metal, which is inputted to the stamping process, and has a planar thickness in the range from about 0.012 to about 0.150 inches, is distorted by stamping so that the individual pieces of scrap from the stamping operation have a contortion (or deflection from flatness) of up to about five inches. This scrap has value, and it is desirable to recover this value by converting the scrap to a form in which it can more conveniently and economically be transported and then used as charge for a steel-making or foundary process furnace.

The typical maximum dimensions of the individual pieces of sheet gauge steel or other metal that constitute the scrap which is the feed material for the process of this invention are approximately five feet by five feet, with a contortion of about five inches.

The prior art process for taking this scrap and putting it into a more desirable form for transportation and reprocessing is commonly known as "baling." In the "baling" process, a batch of sheet gauge scrap metal, for example 1,500 pounds, is charged into the so-called baling box of a baling press. In a typical example, the baling box will have a rectangular horizontal cross-section and the walls of the baling box will be rigid. After a batch of sheet gauge scrap metal has been charged into the baling box, hydraulically driven rams compress the charge into a relatively dense cubic "bale" or bundle having dimensions of, for example, two feet by two feed by three feet. This bale or bundle is more easily transportable and usable in remelting operations.

The bales or bundles produced by the prior art have two distinct disadvantages. First, the bales are not as desirable in modern steel-making technology as the loose, flattened, sheet scrap consisting of discrete pieces. Until 1960, the bulk of steel-making was performed in open hearth, furnaces and the scrap charge was designed for such furnaces since the open hearth furnace operated well using bulky scrap pieces in the form of bales or bundles.

Today, however, the open hearth furnace virtually is extinct, and steel-making normally is performed in basic oxygen or electric furnaces. These new furnaces operate more efficiently with a scrap charge made up of relatively small, free-flowing, discrete pieces. This type of scrap results in higher production rates and less damage to furnace linings and electrodes than bulkier scrap such as bales or bundles.

The second disadvantage of the bales or bundles produced by the prior art is that the baling process has much higher costs associated with initial investment, energy consumption, maintenance, and manpower than does the process provided by the Invention.

OBJECTS OF THIS INVENTION

It is an object of this invention to provide an improved process for flattening sheet gauge metal scrap material into substantially planar and relatively higher bulk density material, for use as scrap feed to a steel-making or foundary process.

Yet another object of this invention is to provide an apparatus for taking pieces of sheet gauge metal scrap material, which have been distorted or contorted from their original planar configuration, and converting them to a more planar configuration having a greater bulk density and being, therefore, more usable as scrap feed for a steel-making or other furnace.

These and other objects will be better appreciated after reading the succeeding description of the invention in conjunction with the accompanying drawings.

SUMMARY OF THE INVENTION

The invention is directed to a process and apparatus for flattening sheet gauge metal scrap material, which is the result of stamping or other metal-working operations, and the pieces of which are significantly distorted or contorted from original planar shape, into a more planar configuration for easier handling, transporting and remelting. As used herein, "sheet gauge metal scrap material" refers to pieces or "clips" of steel or other sheet metal having a thickness of up to about 0.150 inches, typically having significant non-planar surfaces, and often having significant irregular interior and exterior shapes.

Pieces or "clips" of sheet gauge metal scrap material are collected and fed from a suitable hopper into a feed chute and past a deflector/sensor gate, and then through a pair of hydraulically driven compression cylinders, which flatten the individual pieces of sheet gauge metal scrap material into irregular, but substantially more planar scrap material. This product scrap material is discharged from the compression rolls into a discharge chute and onto a discharge conveyor, and then can be collected in suitable containers, and transported and used as scrap feed material for an electric furnace or other process.

The product of the invention is a mass of discontinuously overlapped, substantially more planar pieces of sheet gauge metal scrap material, having individual thicknesses of up to about 0.150 inches, and which lie horizontally, one on the other, and conform re adily to the shape of suitable containers.

DETAILED DESCRIPTION OF THE INVENTION

The invention relates to a process and apparatus for converting sheet gauge metal scrap material into substantially flat, relatively more dense and easily transported and handled pieces for use in charging steel furnaces, and particularly electric furnaces for steel making.

The pieces of contorted sheet gauge metal scrap commonly generated in the conventional metal-stamping plant typically have a bulk density of from about 10 to about 25 pounds per cubic foot, and a principal object of this invention is to create a substantially more planar product having a bulk density in the range from about 40 to about 125 pounds per cubic foot, and preferably at least about 50 pounds per cubic foot.

Sheet gauge metal scrap material preferably used as feed or input to the process of this invention has exterior dimensions of about 40 inches by about 12 inches and a planar thickness or "gauge" of from about 0.012 inches up to about 0.050 inches. The maximum amount of contortion, or deflection from flatness, is about 5 inches in each piece.

Figure 1:
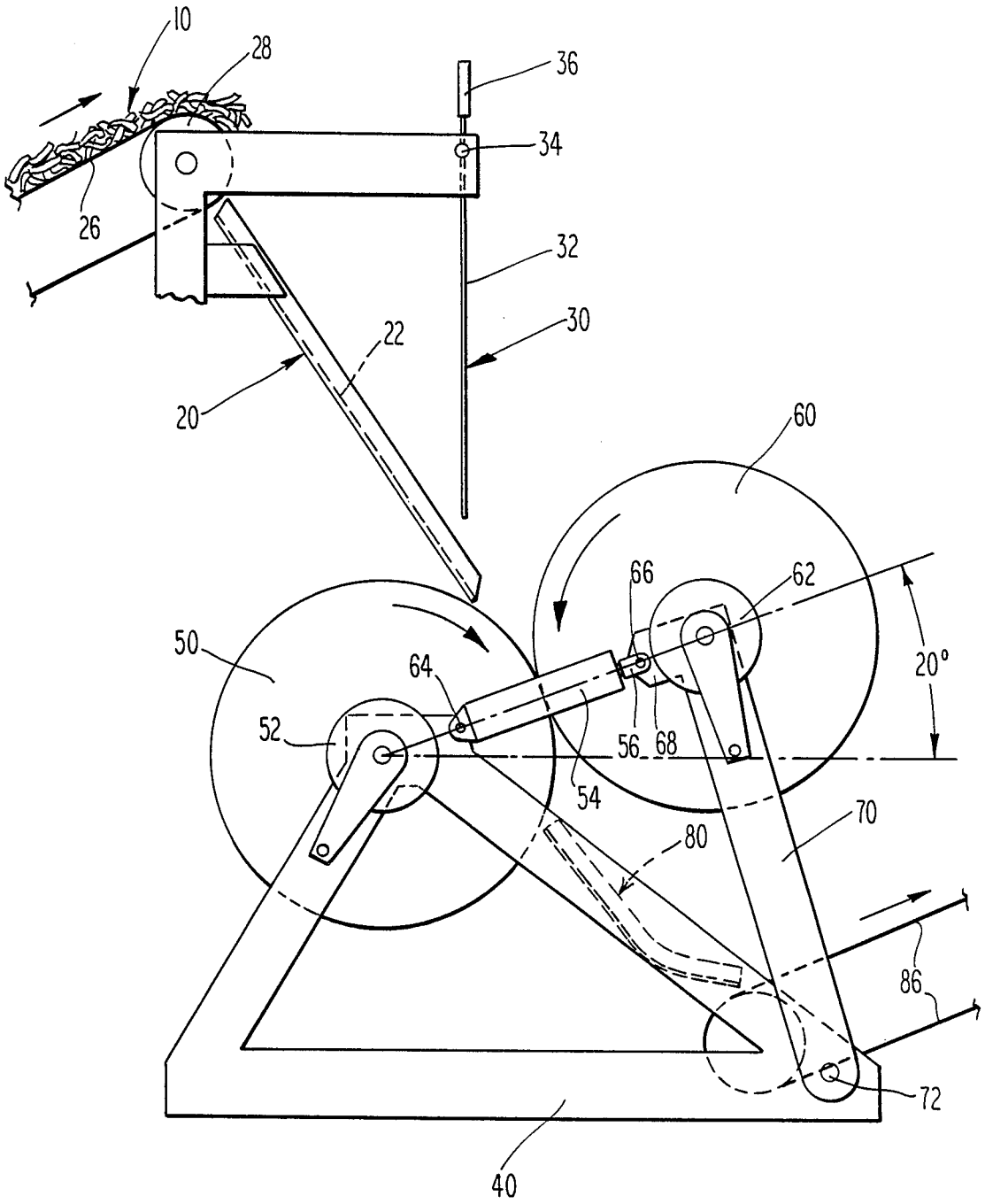
FIG. 1 is a schematic, vertical cross-sectional view of an apparatus of the invention.

Viewing FIG. 1, it will be seen that pieces or "clips" of sheet gauge metal scrap 10 are fed from conveyor 26 and fall by gravity through the feed chute 20. Conveyor 26 is of a conventional design and forms no part of this invention. Feet chute 20 is comprised of planar surface 22, made of hard sheet metal, and mounted at an angle of approximately 55° from the horizontal. The angle is not critical, but 55° has been found to provide good gravity feed of the sheet metal scrap to the pinch rolls 50 and 60.

The opposite surface of the feed chute 20 is formed by a deflector/sensor gate 30, which comprises a pivoted, counter-weighted hard metal flat surface plate 32, which is pivoted about pivot point 34, and is counterweighted by suitable counter-weight 36. The deflector/sensor gate 30 is mounted so that the pivot point 34 is approximately co-axial with the center of the feed chute conveyor roller 28 and so that when gate 30 is in its normal vertical position (shown in FIG. 1), a gap of about five inches exists between the end of gate 30 and the surface 22 of feed chute 20. This gap serves to guide the individual clips of sheet gauge metal scrap material 10 toward pinch rolls 50 and 60. The two pinch rools rotate in opposite clockwise and counterclockwise directions toward each other to provide a positive downward drive of sheet metal clips 10 between the pinch rolls.

In a preferred embodiment of the invention, there are two hydraulic cylinders 54, one mounted at each end of the pinch rolls. Each of the two hydraulic cylinders 54 which interconnect pinch rolls 50 and 60 at opposite ends thereof will exert a compressive force of from approximately 12,500 to approximately 25,000 pounds. At these force levels, the cylinder arms or pistons 56 will move freely to accommodate the varying thicknesses of the sheet gauge metal clips 10 flowing between the rolls.

As seen in FIG. 1, the axis of rotation of movable pinch roll 60 is located at an angle of approximately 20° from the horizontal plane including the axis of pinch roll 50, thereby causing the weight of pinch roll 60 to add a component of compressive force to the metal scrap material 10 while providing a positive gravity feed of the metal scrap into the juncture of pinch rolls 50 and 60.

The piston 56 of each hydraulic cylinder 54 has its outer end pivotally mounted by pin 66 to a plate 68 which is rigidly attached to the pivotal arms 70.

The compression or pinch rolls 50 and 60 and corresponding hydraulic drive motors 52 and 62 for rolls 50 and 60 are rotatably mounted on a suitable rigid steel frame 40. Roll 50 and its hydraulic drive motor 52 are rotatably mounted on the frame 40 and each hydraulic cylinder 54 is pivotally mounted to frame 40 by a pivot pin 64.

Compression roll 60 and its hydraulic drive motor 62 are rotatably mounted between parallel arms 70, and the arms 70 are pivotally mounted at their lower ends to opposing sides of frame 40 by pins 72.

As more fully described below, the rolls or cylinders will automatically open and reclose in response to a signal from the deflector/sensor gate 30 is there is a jam of material at the bottom of feed chute 20.

The feed chute 20 is approximately 48 inches wide and generally and preferably has a width which is at least 110% of the maximum dimension of the sheet gauge metal scrap clips 10 being fed therethrough.

The throughput in the feed chute 20 can be of the order of 25 tons per hour, or more.

Figure 2:
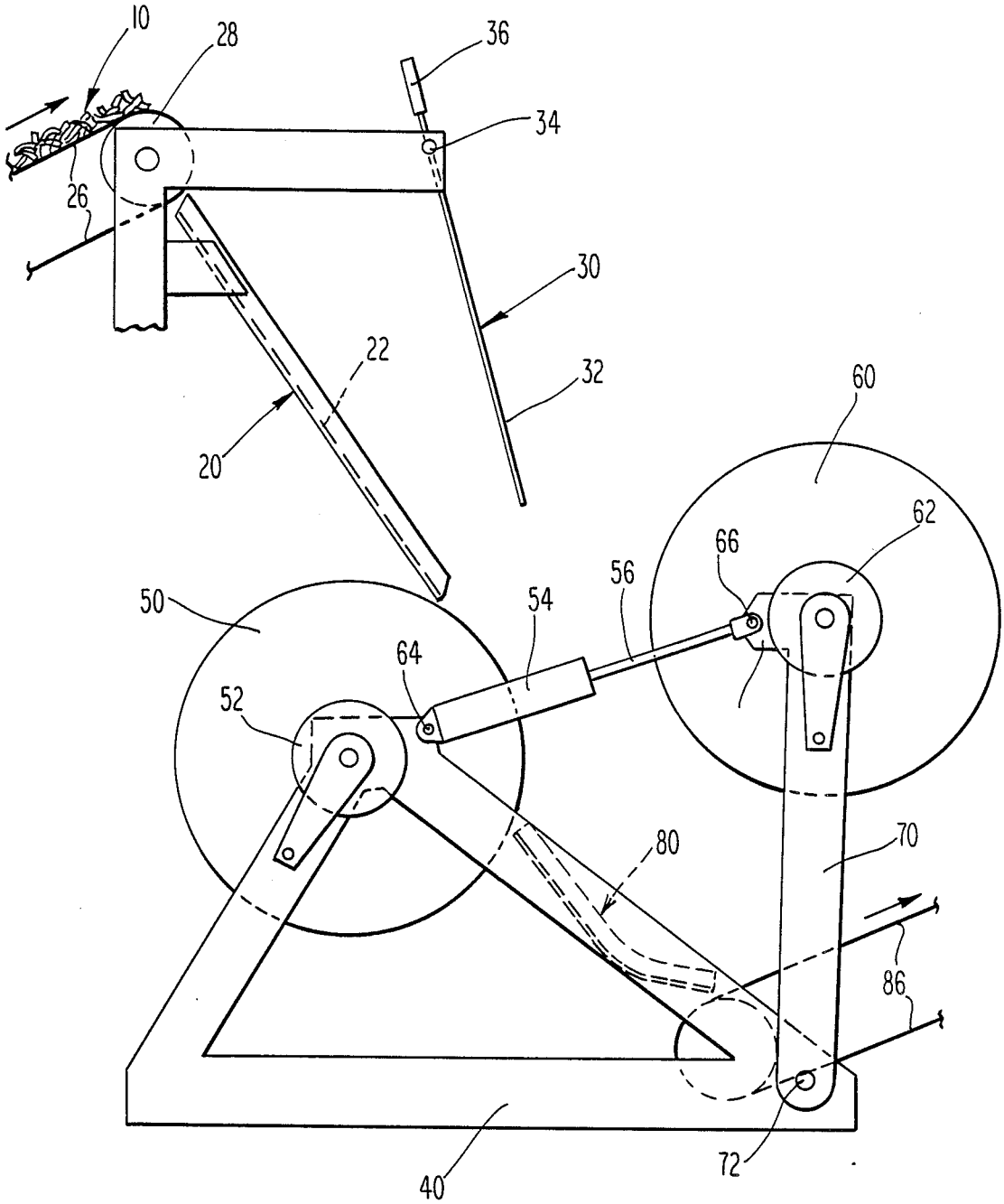
FIG. 2 is a schematic, vertical cross-sectional view of an apparatus of the invention wherein one of the compression cylinders is in the deflected position for relieving an accumulating sheet gauge metal scrap feed.
Figure 3:
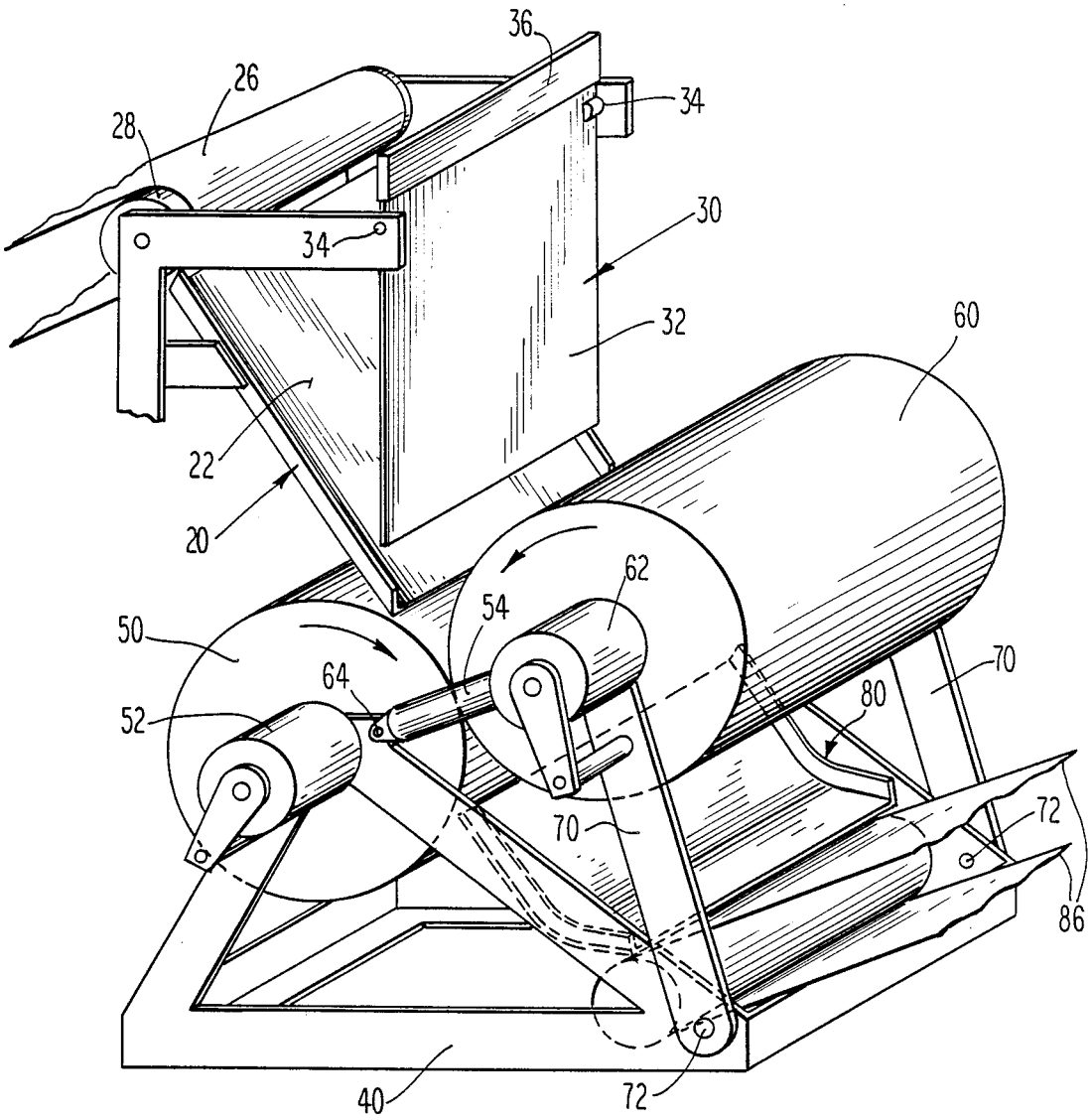
FIG. 3 is a perspective view of an apparatus for practicing the process of the invention.

The deflector/sensor gate 30 is a partially counterbalanced swinging plate 32, which is almost as wide as the feed chute 20. The counterweight 36 conveniently weighs from about 70 percent to about 90 percent, and preferably about 80 percent, of the weight of plate 32. Under normal conditions of continuous feed, individual pieces or clips of scrap will pass freely through the normal five inch spacing at the lower end of gate 30, while overlapping pieces will be deflected for even distribution across the feed chute 20. In the event of a sudden material surge, a jamming of the pinch rolls 50 and 60, or roll stoppage, the gate 30 will be caused by the weight of accumulated material in chute 20 to rotate counterclockwise until it reaches a "relieving position" (shown in FIG. 2), where its lower end will be positioned as much as, say, 20 inches from the surface 22 of feed chute 20, which is four times the normal clearance. The exact "relieving position" spacing is a matter of choice. An electrical interconnection (not shown) between the deflector/ sensor gate 30 and the hydraulic compression cylinders 54 will activate the hydraulic compression cylinders 54 when the gate 30 is open to the "relieving" position to automatically cause pinch rolls 50 and 60 to open to provide a gap of about 24 inches between them, as shown in FIG. 2, and to permit the scrap material 10 which is backing up to fall clear. When it does fall clear, the gate 30 will return by gravity to a position which is at least 10 inches from the chute 20, at which time the electrical interconnection (not shown) will cause the hydraulic cylinders 54 to return pinch rolls 50 and 60 to the normal operating position of FIG. 1.

Pinch rolls 50 and 60 are conveniently 60 inches in diameter. This dimension is determined by the thickness and maximum contortion of the scrap material. The width of the rolls 50 and 60 desirably is twelve inches greater than that of the feed chute, to allow for spreading of the scrap as it is received in the nip of the rolls.

Pinch rolls 50 and 60 are conveniently fabricated from rolled ¾ inch thick mild carbon steel plate with 4½ inch diameter shafts, ½-inch thick end discs, and two ½-inch thick inner discs (not shown) evenly spaced between the end discs for each roll, as determined by roll diameter, width, and total compressive force.

Each pinch roll is independently driven by an hydraulic motor, respectively designated 52 and 62 for rolls 50 and 60, at a variable speed which can desirably be adjusted from about 6.5 to about 13 rpm, and which roughly translates to about 100 to about 200 linear feet per minute of roll surface velocity for a 60 inch diameter roll.

The roll speed is determined by the average feed material flow rate, and both rolls are set to rotate at the same speed. The 50-horsepower hydraulic motor will exert a minimum torque of 8,200 foot pounds at 13 rpm.

The flow rate of scrap material 10, and the compression force of pinch rolls 50 and 60, are adjusted to provide a bulk loading density in the range from about 40 to about 125, and preferably more than 50, pounds per cubic foot of the end-product scrap.

A discharge chute 80, fabricated from hard sheet metal, is rigidly mounted to frame 40 below compression rolls 50 and 60 to receive the substantially flattened product clips existing from the nip of rolls 50 and 60. These clips fall by gravity through discharge chute 80 and onto discharge conveyor 86, which transports the product clips to a convenient location for futher handling. Preferably, discharge chute 80 has a concave longitudinal cross section, so as to deliver the product clips to discharge conveyor 86 without substantial impact with the surface of conveyor 86.

The process of the invention is a process for taking sheet gauge metal scrap material 10, and converting it into a substantially more planar product having a bulk density in the range of from about 40 to about 125 pounds per cubic foot, and preferably at least about 50 pounds per cubic foot, and comprising pieces of not more than approximately 48 inches width by not more than approximately 60 inches length, and preferably pieces of not more than approximately 12 inches width by not more than 40 inches length.

In the process, individual pieces or clips of sheet gauge metal scrap material are fed between a pair of spaced compression rolls under a combined total force exerted by the two hydraulic cylinders 54 of preferably approximately 50,000 pounds, and are guided so that a relatively uniform feed of sheet gauge metal scrap pieces is fed through the pinch rolls at a linear velocity in the range from about 100 to 200 feet per minute.

The end product is a mass of discrete and substantially flattened pieces of sheet gauge metal scrap material, having a bulk density in the range from about 40 to about 125 pounds per cubic foot.

It will be appreciated that there is considerable variation that can be accomplished in the process and apparatus of this invention without departing from the spirit and scope of this invention, and that those variations are contemplated by this invention. For example, the dimensions of the sheet gauge metal scrap feed, the precise size and shape of the end product, the dimensions of the apparatus of the invention, and the loading and operating parameters of the hydraulic pinch rolls can be varied within broad limits within the spirit and scope of this invention.

The invention claimed is:

1. A process for increasing the bulk density of contorted pieces of sheet gauge metal scrap material, comprising the steps of:

(a) introducing a feed consisting of contorted pieces of sheet gauge metal scrap material above and into the converging nip of an opposing parallel pair of oppositely-rotating rigid compression rolls in compressive contact with each other;

(b) passing said feed downwardly between said compression rolls, whereby said contorted pieces of sheet gauge metal scrap material are subjected to a compressive force; and (c) removing from below the nip of said rolls a product consisting of pieces of sheet gauge metal scrap material having an increased bulk density.

2. Process as set forth in claim 1, wherein the combined total comprssive force between said rolls is in the range of from about 25,000 pounds to about 50,000 pounds.

3. Process as set forth in claim 1, wherein said rolls are rotated in opposite directions to produce a downward tangential velocity at their surfaces in the nip of from about 100 to about 200 feet per minute.

4. An apparatus for increasing the bulk density of contorted pieces of sheet gauge metal scrap material, comprising:

(a) a parallel pair of opposing rigid compression rolls;

(b) means for independently and variably driving each of said rolls in the same downward direction at their most proximate surfaces; and (c) means adjustably interconnecting said compression rolls for creating a combined total comprssive force between said rolls of from about 25,000 to about 50,000 pounds.

5. Apparatus as set forth in claim 4, in which the axis of rotation of one compression roll is fixed and the axis of rotation of the other compression roll is movably adjustable, and the movable axis of rotation is normally located at an angle from the fixed axis of rotation of approximately 20° above the horizontal plane through the fixed axis of rotation.

6. An apparatus for increasing the bulk density of contorted pieces of sheet gauge metal scrap material, comprising:

(a) parallel pair of opposing rigid compression rolls;

(b) means for independently and variably driving each of said compression rolls about its axis of rotation in the same downward direction at their most proximate surfaces;

(c) said axis of rotation of one compression roll being fixed, and said axis of rotation of the other compression roll being movably adjustable, with the movable axis of rotation normally located at an angle from the fixed axis of rotation of approximately 20° above the horizontal plane through the fixed axis of rotation;

(d) means adjustably interconnecting said compression rolls for creating a combined total compressive force betwen said rolls of about 25,000 to about 50,000 pounds, (e) a planar feed chute for directing the sheet gauge metal scrap material above and between said pair of comprssion rolls; and (f) movable deflector/sensor gate, normally providing a spacing at its lower end of approximately 5 inches from the nearest surface of said feed chute.

7. Apparatus as set forth in claim 6, wherein said feed chute is inclined downwardly from the horizontal at an angle of approximately 55° and is positioned to discharge slightly above the line of proximity between said pair of compression rolls, and said deflector/sensor gate is counterweighted and pivotally mounted to increase said spacing with respect to said feed chute in response to an accumulation of feed material, and means electronically connecting said deflector/sensor gate and said means adjustably interconnecting said compression rolls to provide a spacing between said compression rolls in response to a deflection of said gate in excess of a predetermined amount.

8. Process as set forth in claim 1, further comprising the step of passing said feed downwardly past a pivotally mounted deflector/sensor gate before said feed passes between said compression rolls, with said deflector/sensor gate being electronically connected to one of said compression rolls having a movably adjustable axis of rotation, so that a spacing between said compression rolls may be provided in response to an accumulation of feed material in the nip of said compression rolls.

9. Process as set forth in claim 8, wherein the combined total compressive force between said rolls is in the range of from about 25,000 pounds to about 50,000 pounds.

10. Process as set forth in claim 8, wherein said rolls are rotated in opposite directions to produce a downward tangential velocity at their surface in the nip of from about 100 to about 200 feet per minute.

* * * * *

UNITED STATES PATENT AND TRADEMARK OFFICE

CERTIFICATE OF CORRECTION

PATENT NO. : 4,739,641

DATED : April 26, 1988

INVENTOR(S) : Alfred G. Hering

It is certified that error appears in the above-identified patent and that said Letters Patent is hereby corrected as shown below:

Page 1, under "References Cited U. S. Patent Documents" heading;
First reference cited should be changed from "Lonel" to --Linel--.

Column 1, Line 57;
"hearth, furnaces" should read --hearth furnaces--.

Column 2, Line 56;
"re adily" should read --readily--.

Column 3, Line 29;
"Feet" should read --Feed--.

Column 3, Line 47;
"two pinch rools" should read --two pinch rolls--.

Column 4, Line 19;
"gate 30 is" should read --gate 30 if--.

Column 5, Line 22;
"existing" should read --exiting--.

UNITED STATES PATENT AND TRADEMARK OFFICE

CERTIFICATE OF CORRECTION

PATENT NO. : 4,739,641

DATED : April 26, 1988

INVENTOR(S) : Alfred G. Hering

It is certified that error appears in the above-identified patent and that said Letters Patent is hereby corrected as shown below:

Column 5, Line 25;
"futher" should read --further--.

Column 6, Claim 2, Line 2;
"comprssive" should read --compressive--.

Column 6, Claim 4, Line 9;
"comprssive" should read --compressive--.

Column 6, Claim 6, Line 19;
"pounds," should read --pounds;--.

Column 6, Claim 6, Line 22;
"comprssive" should read --compressive--.

Column 8, Claim 10, Line 10;
"surface" should read --surfaces--.

Signed and Sealed this

Eighteenth Day of October, 1988

*Attest:*

DONALD J. QUIGG

*Attesting Officer*

*Commissioner of Patents and Trademarks*